US006779935B1

(12) United States Patent
Gemmell

(10) Patent No.: US 6,779,935 B1
(45) Date of Patent: Aug. 24, 2004

(54) PRINTER HAMMERBANK WITH A MAGNETIC SHUNT

(75) Inventor: John W. Gemmell, Aliso Viejo, CA (US)

(73) Assignee: Printronix, Inc., Irvine, CA (US)

( * ) Notice: Subject to any disclaimer, the term of this patent is extended or adjusted under 35 U.S.C. 154(b) by 0 days.

(21) Appl. No.: 10/360,393

(22) Filed: Feb. 6, 2003

(51) Int. Cl.[7] ..... B41J 2/27

(52) U.S. Cl. ..... 400/124.21; 400/124.2; 101/93.04

(58) Field of Search ..... 400/124.01–124.32; 101/93.04, 93.29, 93.42, 93.48

(56) References Cited

U.S. PATENT DOCUMENTS

| | | | | | |
|---|---|---|---|---|---|
| 4,258,623 | A | * | 3/1981 | Barrus et al. | 101/93.04 |
| 4,392,423 | A | * | 7/1983 | Nakajima et al. | 101/93.48 |
| 4,527,469 | A | * | 7/1985 | Wolf et al. | 101/93.04 |
| 4,582,437 | A | * | 4/1986 | Wang | 400/124.2 |
| 5,335,999 | A | * | 8/1994 | Farb et al. | 400/124.21 |
| 5,595,446 | A | * | 1/1997 | Barrus et al. | 400/124.13 |
| 5,743,665 | A | * | 4/1998 | Ryan et al. | 400/323 |

OTHER PUBLICATIONS

The IBM Technical Disclosure Bulletin (NN 9405413), Print Hammer Having Improved Magnetic Flux Means, May 1994, vol. No. 37, Issue No. 5, pp. 413–414.*

The IBM Technical Disclosure Bulletin (NN 9405463), Magnetic Field Linearization for Print Hammer Assembly, May 1994, vol. No. 37, Issue No. 5, pp. 463–464.*

* cited by examiner

*Primary Examiner*—Minh H Chau
(74) *Attorney, Agent, or Firm*—MacPherson Kwok Chen & Heid LLP; Tom Chen

(57) ABSTRACT

An impact line printer comprising a print ribbon wound on a pair of spools for traversal in two directions across a plurality of print hammers having tips for impacting the print ribbon to print on a media. A permanent magnet having two pole pieces having pole piece ends in adjacent relationship to the print hammers retains the print hammers until a coil in associated relationship with each pole piece releases the magnetic retention of the hammers. A magnetically permeable extension is longitudinally adjacent each hammer which acts as a magnetic shunt to permit more rapid printing rates and higher impacts. The extensions conduct and shunt magnetic flux from the hammers through the longitudinally adjacent extensions.

36 Claims, 6 Drawing Sheets

PRINTER HAMMERBANK WITH A MAGNETIC SHUNT

BACKGROUND OF THE INVENTION

1. Field of the Invention

The field of this invention lies within the art of impact printing. Impact printing can take place by a hammer having a tip which impacts a ribbon to place a series of dots or a dot matrix format on an underlying media. The invention more specifically is directed toward hammerbanks of line printers having a series of hammers which are retained by a permanent magnet and are released for impact by an electrical coil which overcomes the permanent magnetism.

2. Background of the Invention and Prior Art

The prior art with respect to impact printers generally incorporates a number of impact printers of various designs and various configurations. One of the preferred types of impact printers are those impact printers referred to as line printers. The configuration of line printers is such where a hammerbank having a number of printing tips impacts a print ribbon overlying a media to be printed upon. The hammers are held and retained by a permanent magnet prior to being released for impact. The permanent magnet provides a certain amount of magnetic flux to the hammer in order to retain it. The flux required is dependent upon the size, form, configuration, and magnetic characteristics of the hammer.

In the design of hammerheads and the hammers in general, there are key elements with regard to maintaining sufficient flux to retain or pull down the hammers. At the same time consideration must be given in allowing the hammers to fire on a rapid and high impact basis.

The retention and return of the hammers is oftentimes referred to as the pull down force by the permanent magnets.

Other characteristics of the hammers must consider the natural frequency of the spring. This is a criteria as to the firing at a particular rate.

Another criteria is the pull down force required by the permanent magnets. Generally, as the mass of the hammer-spring head increases, a greater stored energy can be maintained. However, as can be appreciated, this can be undesirable inasmuch as a greater mass of the head of the hammer can decrease the operational firing rate.

This invention is a significant improvement over the prior art by reason of the fact that it utilizes and replaces part of the hammerhead mass with shunt mass. This causes the hammerhead to be lighter and accelerate faster when released.

To the foregoing extent, the shunts or the fingers that are emplaced between the hammers allows the mass of the hammerhead to be reduced. At the same time the shunts help to maintain the pull down force or retention force by the permanent magnets. Therefore, the natural frequency of the spring can be increased allowing the spring to fire at an increased rate with the same impact energy.

Another improvement of this invention and an object thereof is to create a greater pull down force or retention force without an increase to the hammer mass. This allows the use of a stiffer spring thereby increasing stored energy in the spring. The net result is to increase the impact energy without a decrease in the firing rate.

Both of the foregoing aspects of the impact energy and the operational firing rate can be increased by a trade-off between the two. Thus, one skilled in the art can design the line printers of this invention in a manner to increase impact energy or firing rate. For instance, when multiple forms are being utilized, higher impact is required. On the other hand, when thinner forms are required and a greater speed or firing rate of the hammerbank is required, faster printing can take place.

Thus, with this invention, greater impact and faster firing rates can be accomplished as set forth hereinafter.

SUMMARY OF THE INVENTION

In summation, this invention comprises one or more hammerbank magnetic shunts emplaced between hammers in order to allow a larger magnetic flux to be applied to the bottom of the hammers of the hammerbank through the pole pieces than that flux required to saturate the hammerhead cross section.

More specifically, the invention incorporates the aspects of a hammer shunt plate made of a highly permeable magnetic material having fingers that are placed between the hammerheads. The flux leaving the bottom of the pole piece in a dual pole piece arrangement enters the bottom of the hammerhead. The quantity of flux entering the bottom of the hammerhead is beyond the saturation flux of the hammerhead cross section. This saturation causes an increase in the MMF drop along the hammerhead forcing the flux into the shunt fingers.

A key element is to cause the entire flux from the pole piece to enter the bottom of the hammerhead. It is this flux that creates a magnetic force pulling the hammer down. The use of the shunt fingers replaces part of the hammerhead mass with the shunt finger mass so that the hammerhead can be lighter and accelerate faster when released.

The invention can also allow a reduction of the mass of the hammerheads while maintaining pull down force. This increases the natural frequency of the spring force allowing the hammer to be fired at an increased rate.

On the other hand, a greater pull down force or retention can be achieved without an increase to the head mass providing for increased stored energy so that greater impact energy without a decrease in the operational firing rate can be accommodated.

DETAILED DESCRIPTION OF THE PREFERRED EMBODIMENTS

Figure 1:
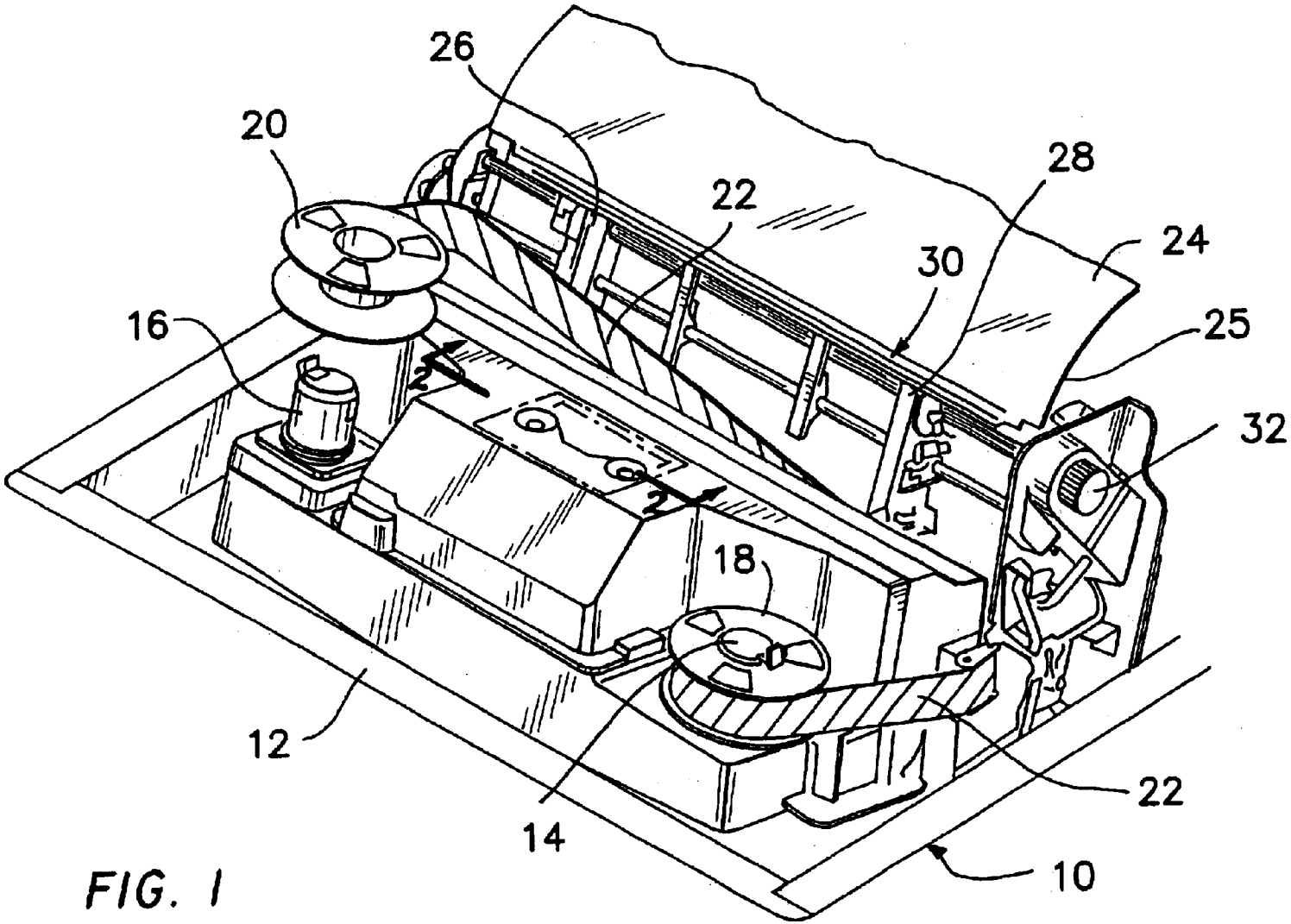
FIG. 1 shows a perspective view of a line printer.

Looking more specifically at FIG. 1, a perspective view of a line printer has been shown. The line printer can be mounted on a stand, base, or be incorporated in a cabinet. In this particular showing, a line printer 10 is shown having a base frame 12. The base frame 12 mounts the various components of the line printer including hubs 14 and 16. Hubs 14 and 16 are utilized to mount spools 18 and 20. Spools 18 and 20 are respectively the feed ribbon spool and takeup spool.

Wrapped around the spools 18 and 20 is a print ribbon 22 which is utilized to print on a media 24

The media 24 is shown overlying a support plate 25. Such media can be fan fold forms., bar code labels, combinations of plastic and paper labels and formats, paper media for graphics, and other such items. Depending upon the thickness of the media 24, the high impact of printing that is developed by this invention can improve the multi-form and multi-layered printing by the improved impact. Also, depending upon the speed that is desired for printing on the media 24, the invention improves the rapidity of movement of the media for increased printing by the ribbon 22.

A well known method of moving the media 24 is by tractors 26 and 28 driven by the media drive shaft 30. The media drive shaft 30 also incorporates the ability to increment the media 24 by a manual knurled knob 32. This moves the media 24 on a manual basis for indexing, alignment, or other purposes.

A printer controller is utilized to control the various components and cause the printing and firing of the hammers against the ribbon 22. This includes driving and controlling the hubs 14 and 16 for traversing the hammers to be described hereinafter.

Figure 2:
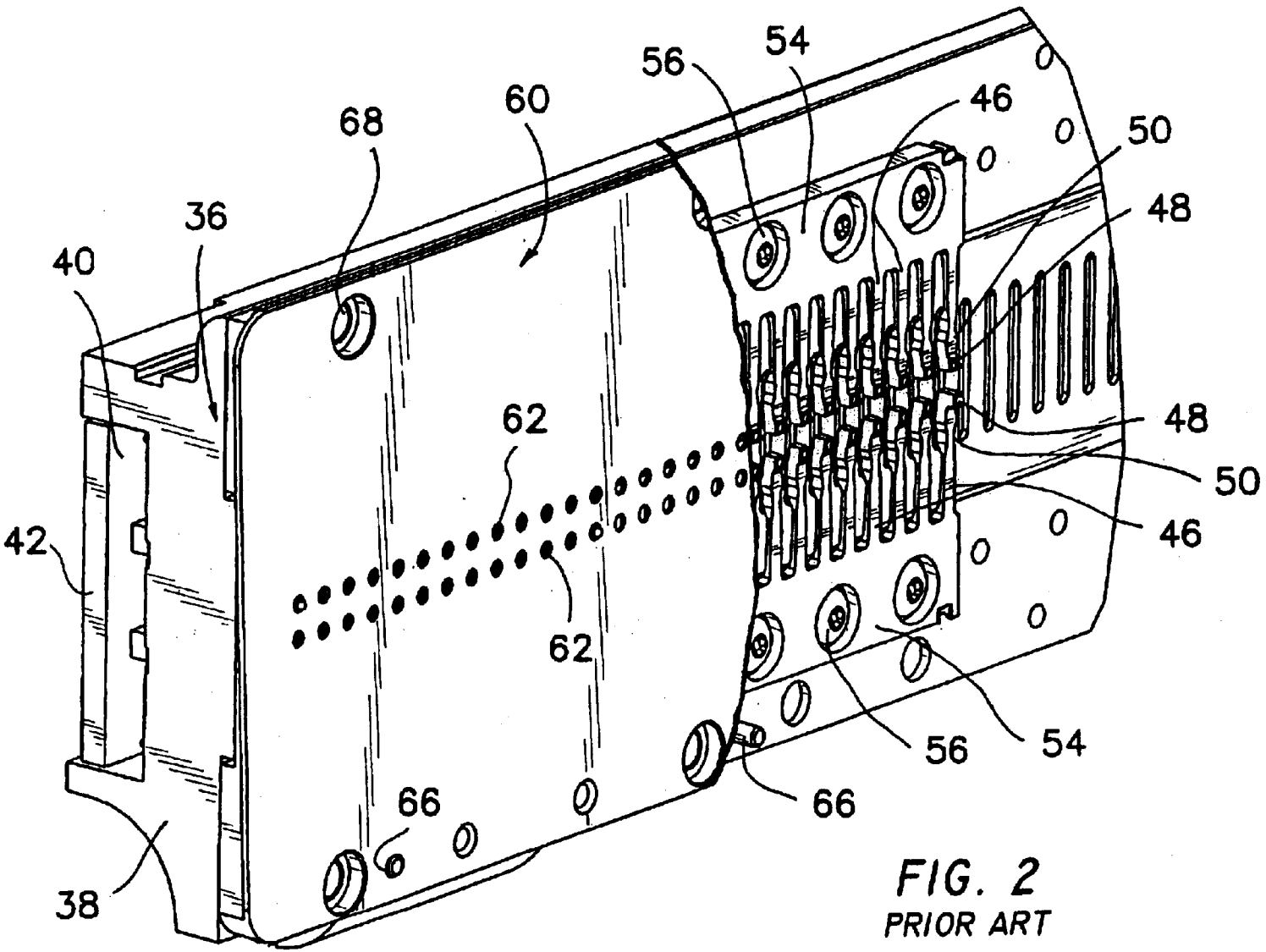
FIG. 2 PRIOR ART
FIG. 2 shows a perspective view of the prior art as to a double row hammerbank in a fragmented configuration as seen in the direction of lines 2—2 of FIG. 1.

Looking more specifically at FIG. 2, it can be seen that a hammerbank of the prior art has been shown, namely hammerbank 36. The hammerbank 36 is formed with a machined or cast base 38 having an elongated channel or groove 40. The elongated channel or groove 40 receives a circuit board 42 therein which provides the driving of the respective coils to cause firing of the hammers.

The showing of FIG. 2 is of a double row hammerbank having hammers 46 on the top and the bottom rows with respective tips 48 at the ends of the enlarged heads 50 on the hammers. The hammers 46 are formed on frets 54. These frets 54 are secured by screws 56.

A cover plate 60 is utilized to cover the hammers. The cover plate 60 incorporates a number of openings 62 that are indexed respectively to the tips 48 of the hammers 46. The cover plate 60 can seat proximate to the frets 54. It is indexed to the tips 48 which are released through the openings 62 against a print ribbon such as print ribbon 22. The tips 48 impact against the ribbon 22 and the media 24 which is attendantly masked by a mask. The mask masking the media 24 from the ribbon 22 has openings indexed to openings 62 which receive the impacts by the tips 48.

In order to secure the cover 60 to the base 36, indexing studs 66 are utilized and various securements through openings such as opening 68 can be utilized or other such securement.

Figure 3:
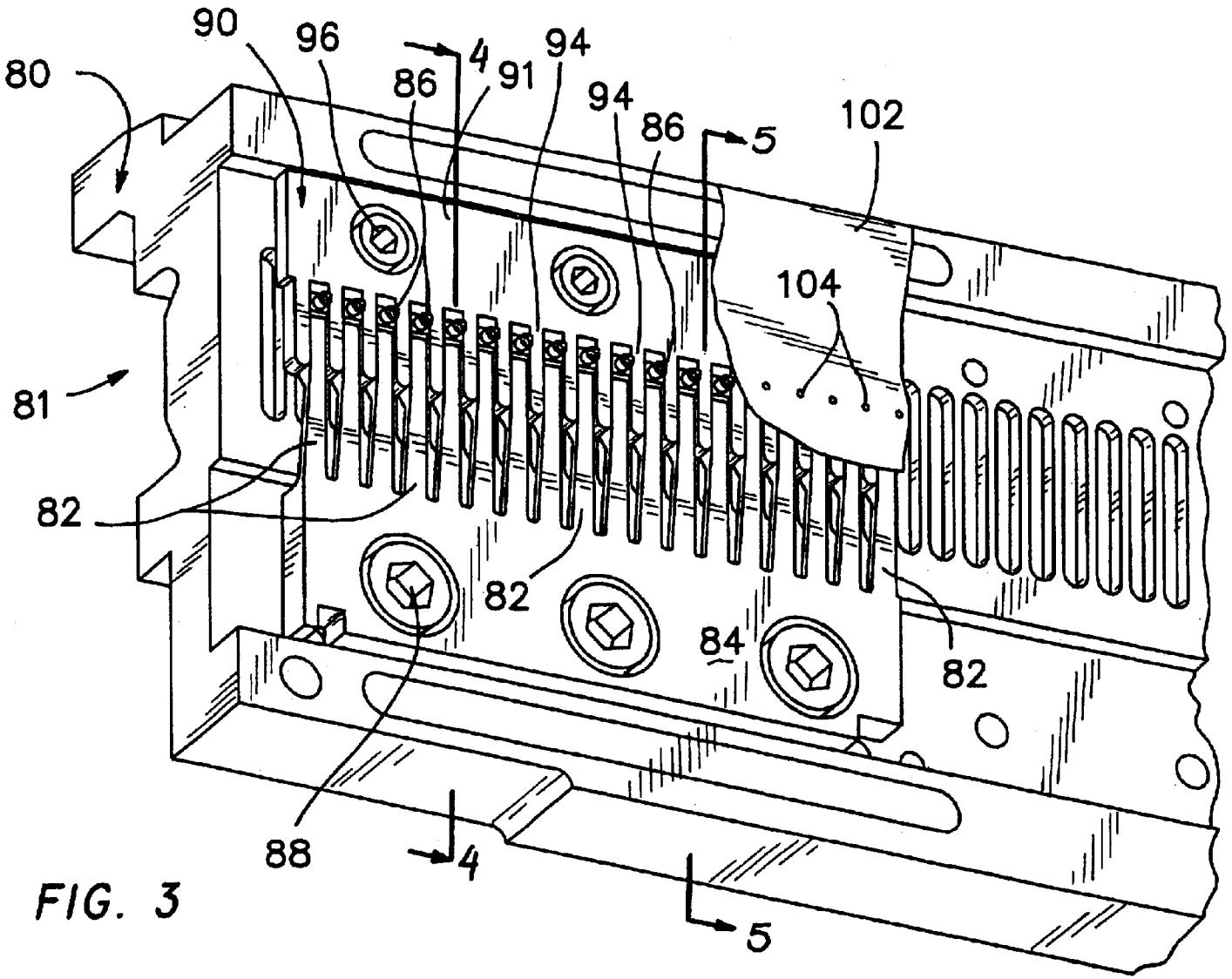
FIG. 3 shows a perspective fragmented portion of the invention utilizing the shunts.

Looking more specifically at FIG. 3, it can be seen wherein a hammerbank of this invention has been shown in a fragmented perspective form. The hammerbank replaces the prior art in great measure whether it be a single hammerbank or row of hammers as in the showing of FIG. 3 or a double hammerbank showing as in FIG. 2. A substitution would also be fundamentally with regard to the drives from the printed circuit board and the permanent magnet as set forth hereinafter.

Looking more specifically at the invention of FIG. 3, it can be seen that a base or support of the hammerbank 80 has been shown analogous to the base 38. A group of hammers 82 have been shown that have been formed on a fret 84 analogous to the fret 54 of the prior art. The respective hammers 82 have heads terminating in tips 86. The fret 84 with the hammers 82 can be secured by screws or other fittings 88 into the base 80 of the hammerbank.

Looking more specifically at the upper portion of FIG. 3, it can be seen that a fret 90 has been shown with a plurality of fingers, extensions, appendages, shunts, or shunt extensions 94 that have been formed from the fret 90. The fret 90 is formed with an upper shunt plate portion 91 to which the extensions 94 are connected. These extensions or shunts have been secured on the base 80 by the plate 91 as to the respective formation of the fret shunts by means of screws or other securement means 96.

Both the extensions 94 and shunt plate portion 91 are formed of a highly permeable magnetic material. In effect, conductance of flux to a significant degree is desired through the extension 94 and the plate 91 which form the entire fret 90.

Here again, a cover 60 can be utilized to cover the hammer 82 and the respective tips 86.

Again, looking at FIG. 3, a cover 102 has been shown analogous to the cover 60 of the prior art. This cover 102 also has openings 104 through which the tips 86 can project for impact printing. Here again, any type of cover or plate can be utilized in order to provide for the cover of the line printer.

Figure 4:
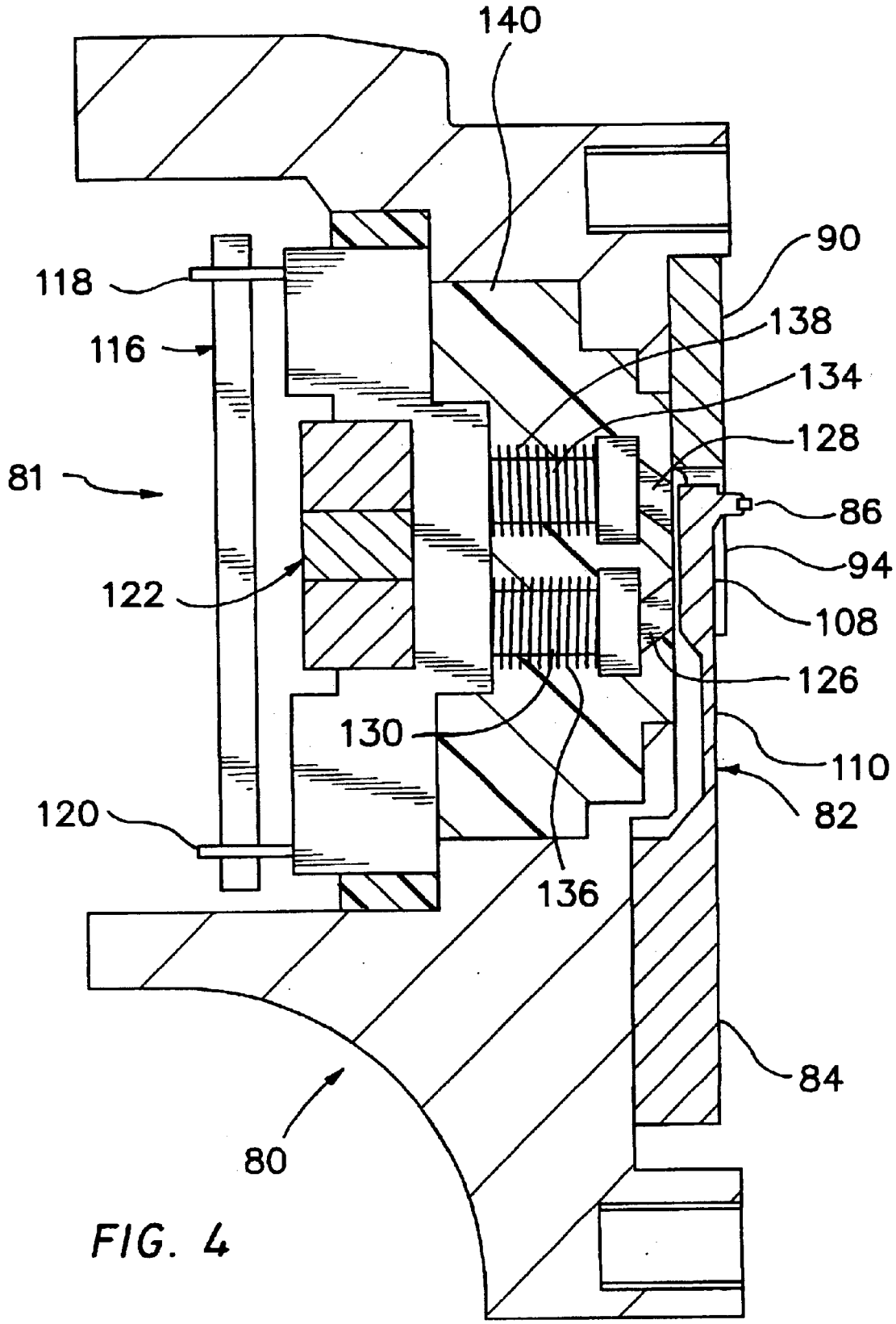
FIG. 4 shows a sectional view of a hammer of this invention as sectioned along lines 4—4 of FIG. 3.

A sectional view as shown in FIG. 4 shows the hammers 82 with the fret 84 on which they are formed. The hammers 82 have the tips 86 that are shown with an enlarged hammerhead 108. The enlarged hammerhead 108 is mounted on a relatively narrow spring portion 110.

Adjacent to the hammerhead 108 are the shunts, extensions, or fingers 94 set forth hereinbefore that have been formed and mounted on the shunt fret 90. Within the hammerbank base and the channel 81 analogous to channel 40 of the prior art, is a printed circuit board 116 analogous to prior art circuit board 42. The printed circuit board 116 has terminals 118 and 120 that allow the circuit board 116 to be connected to a printer controller.

Within a channel is a permanent magnet 122. The magnet 122 retains the hammers 82 into a position in close proximity to a lower pole piece extension 126 and an upper pole piece extension 128.

The pole piece extensions 126 and 128 are respectively extensions of pole pieces 130 and 134 having coils 136 and 138 wrapped around the pole pieces. The permanent magnetism of magnet 122 pulls the hammerhead 108 into juxtaposition with the pole piece extensions 126 and 128. The hammers 82 are retained until released by a magnetomotive force through coils 134 and 136 as driven by circuit board 116.

Figure 7:
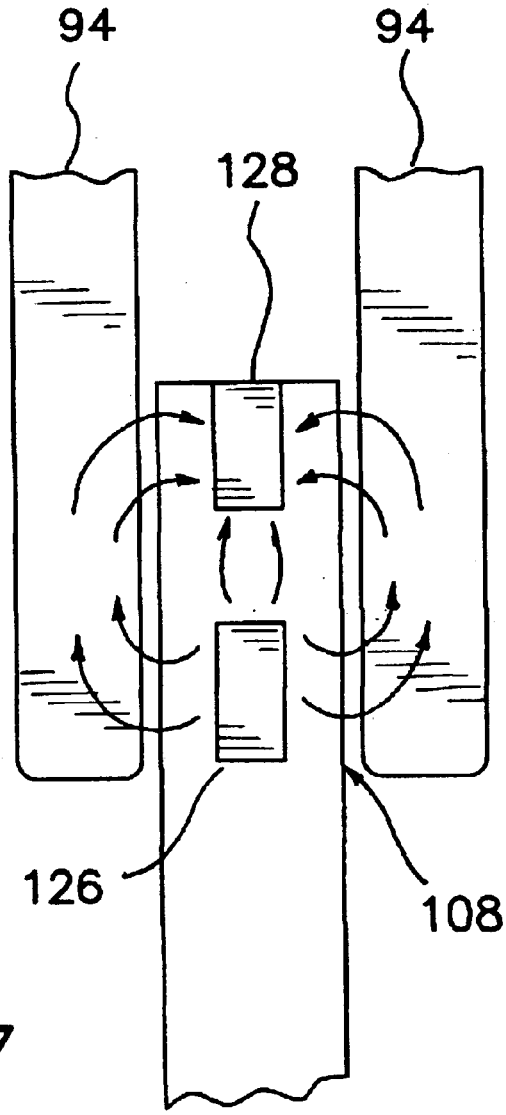
FIG. 7 shows an elevation view of the flux interacting with the pole pieces and the shunts of this invention.

FIG. 4 shows the extensions of the pole pieces 126 and 128. The pole pieces are relatively flat on their exposed surfaces. The pole pieces 126 and 128 have been shown in the elevation view of FIG. 7. FIG. 7 shows the pole piece ends of the pole pieces 126 and 128 seated between the fingers, extensions, or shunts 94 as shown previously in FIGS. 3 and 4.

Figure 5:
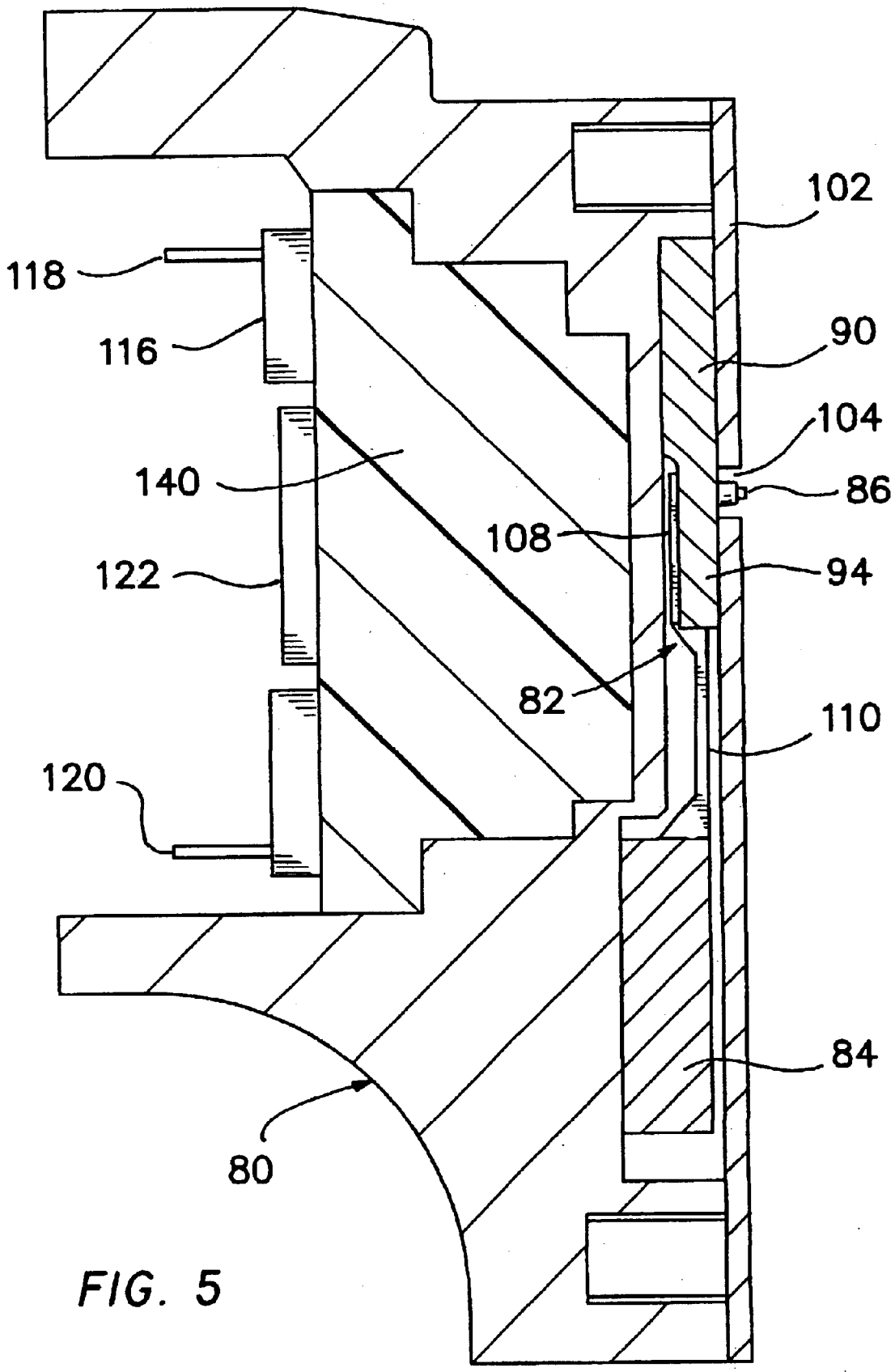
FIG. 5 shows a sectional view of a shunt as sectioned along lines 5—5 of FIG. 3.

Again, looking more specifically at FIG. 5, it can be seen that the cover 102 is shown with the openings 104 through which the tips 86 of the hammers 82 can project.

As seen from the cross section of FIG. 5, the hammerhead 108 should be designed such that it is closer to the pole piece than the extensions 94. This is in order to assure that the hammerhead 108 receives a significant amount of the flux rather than it flowing initially before hammer release from the pole pieces 126 and 128 through the extensions 94.

As will be seen in FIG. 5, a showing of the enlarged hammerhead 108 of the hammer 82 is such wherein it is closer to the pole piece 126 and 128 ends. This is in order to rely upon the lesser amount of magnetic resistance in any air gap so that the pole pieces will function with respect to the hammers 82 rather than flux being imparted to the extensions 94 initially.

The showing of FIG. 5 also includes a wall portion 140. The wall portion 140 is fundamentally the area that separates each respective series of pole pieces 130 and 134. These also separate the pole pieces 126 and 128 ends so that a finite relatively smooth surface is seen at the ends of pole pieces 126 and 128. In effect, the pole pieces 126 and 128 ends are substantially flush with the surface of the base 80 of the hammerbank.

As previously stated the base 80 can be made from a casting or milled bar. The pole pieces 130 and 134 are inserted therein and then potted with a potting material or other material which provides the separation walls 140 as can be seen in the two respective FIGS. 4 and 5. The potting is filled in around the pole pieces 130 and 134 as well as the coils 136 and 138.

Figure 6:
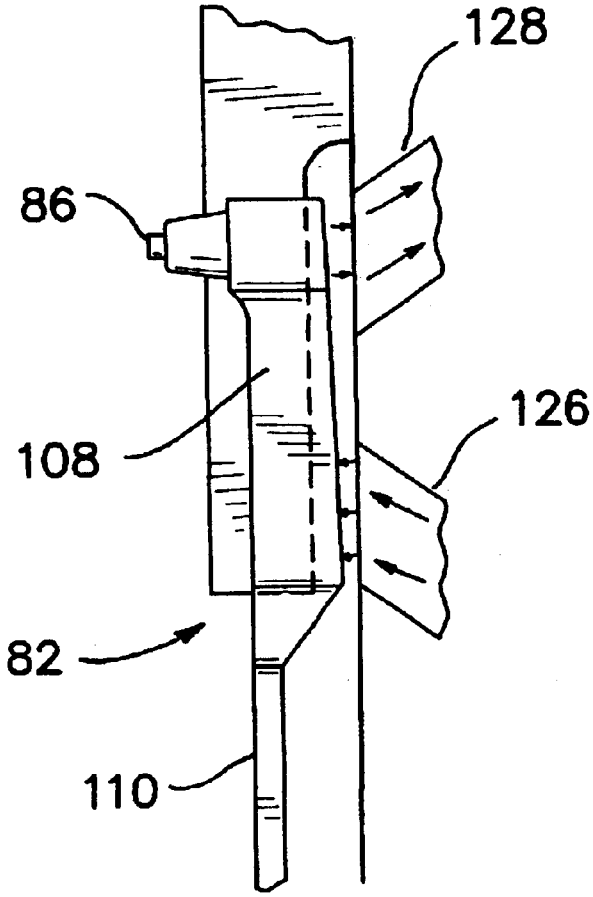
FIG. 6 shows a pole piece interacting with the respective flux of a hammer of the hammerbank.

The showings of FIGS. 4, 5, 6, and 7 are such wherein a dynamic released configuration is shown. Normally, when the hammers 82 are retracted or in the pulled back position, they are adjacent to the ends of the pole pieces 126 and 128. In FIG. 6, the hammer 82 has been released so that it is specifically moving into an impacting position with its tip 86 against the print ribbon 22. However, after release, the pull back force of the flux at the ends of pole pieces 126 and 128 pulls the hammerhead 108 back into contact therewith.

Looking more specifically at FIGS. 6 and 7, it can be seen that the lines of flux flow from the lower pole piece 126 end through the hammerhead 108 and shunts 94 and then back through the upper pole piece 128 end. The division of flux between the hammerhead 108 and shunt pieces 94 depends on the cross sectional area of the hammerhead which relates to the flux required to saturate.

The concept and features of this invention are such where the shunts or extensions 94 are formed from the fret 90 which includes the shunt plate 91. Both the plate 91 or fret 90 and extension 94 are made of a highly permeable magnetic material.

The flux as seen in FIGS. 6 and 7 leaves the pole piece 126 end in order to retract the hammerhead 108 into a pull down position. The design is such where the quantity of flux is beyond the saturation flux of the hammerhead 108. This causes an increase in the MMF drop along the hammerhead 108 forcing the flux into the shunt fingers or extension 94 as can be seen in FIG. 7.

The design and path of the magnetism of the permanent magnet 122 is through the pole pieces 126 and 128. For improved performance the entire flux of the pole piece should enter the bottom of the hammerhead 108. It is this flux that creates the magnetic force pulling the hammerhead 108 backwardly after release. The dynamic position of the firing of the hammer 82 with the respective hammerheads 108 are shown released in FIGS. 4, 5, and 6. When the hammer 82 is pulled back, the spring portion 110 is slightly bowed, and upper and lower portions of the hammerhead 108 are in close contact or adjacent relationship with the ends of pole pieces 126 and 128.

Inasmuch as the mass of the hammerhead is replaced with the mass of the shunt fingers or extensions 94, the hammerhead 108 can be lighter and can accelerate faster when released. The foregoing results in the shunt fingers or extensions 94 allowing the mass of the hammerhead 108 to be reduced while at the same time maintaining the pull down force or pull back force through the pole piece 126 and 128 ends. Therefore, the natural frequency of the spring portion 110 can be increased. This allows the hammers 82 to fire at an increased rate with the same energy.

A greater pull down force can be achieved without an increase in the mass of the hammerhead 108 or hammer 82. Thus, the use of a stiffer spring 110 can be utilized which increases the stored energy in the spring. The net effect is that an increase in the hammer 82 impact by the tips 86 increases the impact energy without a decrease in the operational firing rate.

The foregoing improvements can be effected depending upon whether a faster firing rate is desired or a greater impact. In the alternative, a degree of both increased firing rates and increased impact force can be effected with a balance between each characteristic. A faster firing rate would be such where greater throughput of the printer is experienced. On the other hand, when multi-forms having 4, 5, 6, or more layers are utilized, a greater impact is desirable.

Depending upon the net results desired, either the increased rate or the higher impact can be implemented depending upon the particular design and functions of the printer. The effect is so that both the impact energy and operational firing rate can be increased by a trade-off between one of the foregoing design characteristics.

The cover 102 can rest on top of the shunt fingers or extensions 94 to provide a low reluctance path to the cover. This allows the cover mass to act as part of the flux shunting mechanism of the fingers or extensions 94. It has been found that the shunt path of the fingers or extensions 94 are such where greater flux is carried through them rather than through the cover 102.

What is claimed is:

1. A line printer comprising:

a plurality of hammers mounted on a hammerbank having printing tips that impact a print ribbon for printing on a given media;

a permanent magnet for retaining said hammers;

an electrical drive for releasing said hammers from retention by said permanent magnet; and, two magnetically permeable extensions in longitudinal placement on either side of a first one of said hammers and along the same plane as said hammers for shunting flux from said permanent magnet.

2. The line printer as claimed in claim 1 further comprising:

said permanent magnet is magnetically connected to pairs of pole pieces with ends in adjacent relationship to said hammers.

3. The line printer as claimed in claim 2 further comprising:

each hammer has an enlarged hammerhead; and, said hammerhead has one portion in adjacent relationship to one pole piece end, and the other portion in adjacent relationship to the other pole piece end.

4. The line printer as claimed in claim 3 further comprising:

the flux from one of said pole piece end travels through said hammerhead to the other of said pole piece end in a saturated or greater state.

5. The line printer as claimed in claim 4 wherein:

said extension shunts a portion of said flux from said hammerhead.

6. The line printer as claimed in claim 5 further comprising:

a cover overlying said extensions which serve to shunt a portion of the flux.

7. The line printer as claimed in claim 1 further comprising:

said hammerbank is formed with two rows of hammers and two rows of extensions for printing in double rows.

8. The line printer of claim 1, wherein said flux travels into and out of the extensions through the sides of the first one of the hammers and the sides of the extensions.

9. A line printer comprising:

a row of hammers formed on frets mounted on a base;

a permanent magnet magnetically connected to two pole pieces, each pole piece having an end in adjacent relationship to one of said hammers for pulling back and retaining said hammers against said pole piece ends; and, two magnetic shunts, one on each side of a first one of said hammers and on the same plane as the row of hammers for shunting flux from said hammers to one of said pole pieces.

10. The line printer as claimed in claim 9 further comprising:

said hammers have an enlarged head; and, the flux from one of said pole piece ends saturates the hammer.

11. The line printer as claimed in claim 9 further comprising:

said shunts are formed as extensions between adjacent hammers.

12. The line printer as claimed in claim 11 further comprising:

said shunts are formed as one or more extensions from a plate.

13. The line printer as claimed in claim 12 further comprising:

said shunts are aligned between said hammers in adjacent longitudinal side by side relationship.

14. The line printer of claim 9, wherein the two magnetic shunts flux through the sides of the two magnetic shunts and the sides of the first one of said hammers.

15. An impact line printer comprising:

a pair of hubs that are driven in a rotational manner;

a print ribbon wound on a pair of spools mounted on said hubs for traversal in two directions;

a plurality of print hammers having tips for impacting said print ribbon to print on a media;

a permanent magnet having two pole pieces with pole piece ends in adjacent relationship to said print hammers for retaining said print hammers;

a coil in associated relationship with each pole piece for releasing the magnetic retention of said hammers; and, two magnetically permeable extensions, each adjacent to a first one of the hammers along a longitudinal direction of the print hammers, which act as magnetic shunts.

16. The printer as claimed in claim 15 further comprising:

said extensions are formed with a plate having a plurality of extensions; and, said hammers are formed on a plate having a plurality of hammers.

17. The printer as claimed in claim 15 further comprising:

said hammers have an enlarged head and an intermediate thinner portion between said head and said plate.

18. The printer as claimed in claim 15 wherein:

said extensions are at a greater distance from said pole piece ends than said hammers when said hammers are pulled back.

19. The printer as claimed in claim 15 further comprising:

a hammerbank cover that serves as a partial magnetic shunt with said extensions.

20. The printer as claimed in claim 15 wherein:

said hammers are arranged in two rows for printing double rows of print.

21. The printer of claim 15, wherein the two magnetically permeable extensions shunt flux through the sides of the two extensions and the sides of the first one of said hammers.

22. A magnetic shunt and print hammer system for a line printer comprising:

a plurality of hammers having printing tips for printing by an ink ribbon;

a permanent magnet having a pair of pole pieces with pole piece ends in adjacent relationship to said hammers to retain said hammers;

an electrical drive for releasing said hammers from said permanent magnetism; and, two magnetically conductive extensions placed on either side of and in longitudinal relationship to a first one of said hammers for shunting a magnetic force between said pole pieces.

23. The magnetic shunt and print hammer system as claimed in claim 22 further comprising:

hammers having a spring portion.

24. The magnetic shunt and print hammer system as claimed in claim 22 further comprising:

said extensions are mounted or formed on a magnetically conductive plate which serves in part as a shunt with said extensions.

25. The system of claim 22, wherein the two magnetically conductive extensions shunt flux through the sides of the two extensions and the sides of the first one of said hammers.

26. A method of printing comprising:

providing a line printer having a plurality of hammers which impact a ribbon which traverses between two spools;

retaining said hammers until release by a permanent magnet having two pole pieces with pole piece ends in adjacent relationship to said hammers; and, conducting and shunting permanent magnetism from said hammers through extensions adjacent to both sides of each of the hammers and along the same plane as said plurality of hammers.

27. The method as claimed in claim 26 further comprising:

providing a gap between said extensions and said pole pieces greater than any gap between said hammer and said pole pieces when the hammers are retained before firing.

28. The method as claimed in claim 26 further comprising:

said hammers having an enlarged head and an intermediate spring portion.

29. The method as claimed in claim 28 further comprising:

providing extensions mounted or formed on a magnetically permeable member, and, shunting magnetic flux in part through said magnetically permeable member.

30. The method of claim 26, wherein the shunting is through the sides of the extensions and the sides of the hammers.

31. A method of shunting magnetic flux in a line printer comprising:

providing a plurality of hammers in alignment for printing by impacts against a ribbon;

retaining said hammers by a permanent magnet until released for impacting said ribbon; and, shunting magnetic flux in part through extensions located on either side of said hammers and on the same plane as said hammers for a return path of said flux to said permanent magnet through the side of said hammers.

32. The method as claimed in claim 31 further comprising:

providing pole pieces magnetically connected to said permanent magnet; and, shunting flux by said extensions from one pole piece to the other.

33. The method as claimed in claim 32 further comprising:

providing pole pieces having ends adjacent to said hammers; and, conducting flux to the pole piece end closest to the end of said hammer from a pole piece intermediate the end of said hammer and a mounting of said hammer.

34. The method as claimed in claim 33 further comprising:

providing a hammer with an enlarged head.

35. The method as claimed in claim 33 further comprising:

mounting said extensions on a magnetically conductive member;

placing a cover over said hammer and said extensions; and, conducting flux from said pole pieces in part through said magnetically conductive member.

36. The method of claim 31, wherein the flux travels through the sides of the extensions and the sides of the hammers.

* * * * *